US011841025B2

(12) United States Patent
Merheim et al.

(10) Patent No.: US 11,841,025 B2
(45) Date of Patent: Dec. 12, 2023

(54) METHOD FOR ANALYZING, MONITORING, OPTIMIZING AND/OR COMPARING ENERGY EFFICIENCY IN A MULTIPLE COMPRESSOR SYSTEM

(71) Applicant: Enersize OY

(72) Inventors: Christian Merheim, Helsingborg (SE); Anders Sjögren, Lund (SE)

(73) Assignee: ENERSIZE OY, Helsinki (FI)

( * ) Notice: Subject to any disclaimer, the term of this patent is extended or adjusted under 35 U.S.C. 154(b) by 586 days.

(21) Appl. No.: 16/982,534

(22) PCT Filed: Mar. 19, 2019

(86) PCT No.: PCT/EP2019/056813

§ 371 (c)(1),
(2) Date: Sep. 18, 2020

(87) PCT Pub. No.: WO2019/180003

PCT Pub. Date: Sep. 26, 2019

(65) Prior Publication Data

US 2021/0003137 A1 Jan. 7, 2021

(30) Foreign Application Priority Data

Mar. 20, 2018 (CN) ..... 201810231363.4
Mar. 20, 2018 (SE) ..... 1850311-0
Oct. 5, 2018 (SE) ..... 1851209-5

(51) Int. Cl.
*F04D 25/16* (2006.01)
*F04C 28/02* (2006.01)
(Continued)

(52) U.S. Cl.
CPC ..... *F04D 25/16* (2013.01); *F04C 23/00* (2013.01); *F04C 28/02* (2013.01); *F04D 27/001* (2013.01);
(Continued)

(58) Field of Classification Search
CPC ..... F04D 25/16; F04D 27/001; F04C 28/02; F04C 23/00; F04C 2270/80; F04B 2205/09; F04B 2203/0208
See application file for complete search history.

(56) References Cited

U.S. PATENT DOCUMENTS 5,742,500 A 4/1998 Irvin
7,155,367 B1 12/2006 Shapiro et al.
(Continued)

FOREIGN PATENT DOCUMENTS

CN 101155995 A 4/2008
CN 102234346 A 11/2011
(Continued)

OTHER PUBLICATIONS

Staroselsky N et al.: "Parallel Centrifugal Gas Compressors Can Be Controlled More Effectively", Oil and Gas Journal, Pennwell, Houston, TX, US, vol. 84, No. 44, Nov. 3, 1986 (Nov. 3, 1986), pp. 78-82, XP002023664, ISSN: 0030-1388.
(Continued)

*Primary Examiner* — Christopher S Bobish
(74) *Attorney, Agent, or Firm* — Moser Taboada

(57) ABSTRACT

The present invention provides a method for analyzing, monitoring, optimizing and/or comparing energy used for producing a unit of mass or volume of compressed gas (Specific Energy Consumption) in relation to a common output flow in a multiple compressor system, said method comprising: —collecting measured data of common output flow and energy/power use and calculating the specific energy consumption in the multiple compressor system, —identifying which data points of measured specific energy consumption that affiliate to a certain compressor or compressor combination in the multiple compressor system and/or operating mode(s) of the multiple compressor system; and —plotting the data points of measured specific
(Continued)

Figure 1:
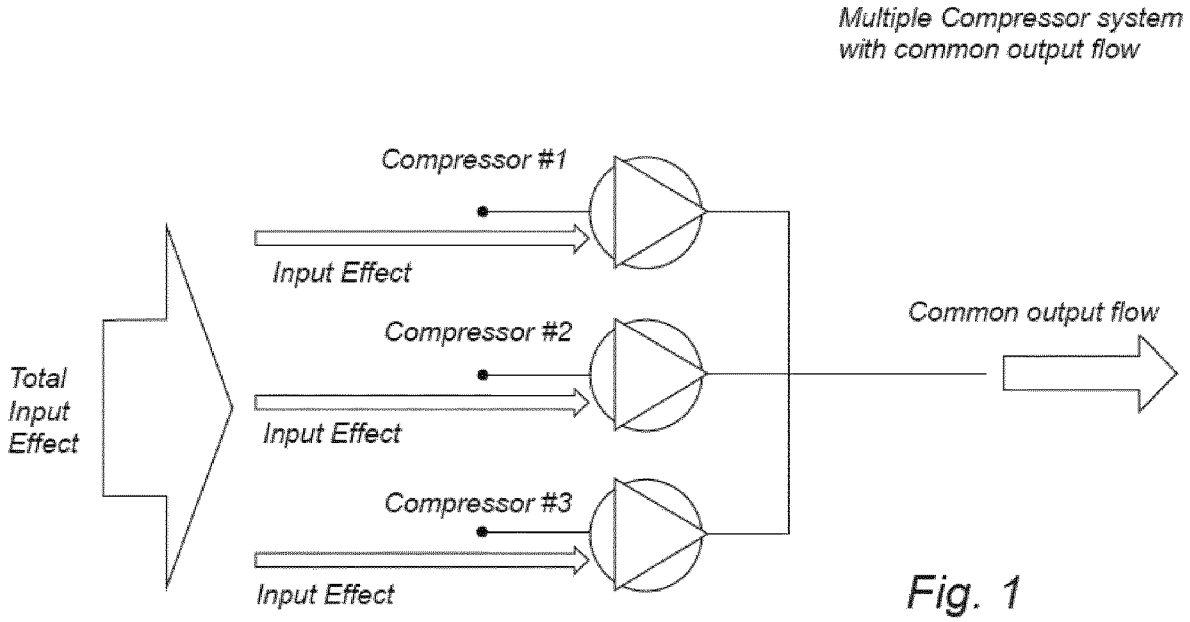

energy consumption that affiliate to a certain compressor or compressor combination in the multiple compressor system and/or operating mode of the multiple compressor system and marking affiliation of said data points to the certain compressor or compressor combination and/or operating mode.

12 Claims, 13 Drawing Sheets

(51) Int. Cl.
*F04D 27/00* (2006.01)
*F04C 23/00* (2006.01)

(52) U.S. Cl.
CPC ... *F04B 2203/0208* (2013.01); *F04B 2205/09* (2013.01); *F04C 2270/80* (2013.01)

(56) References Cited

U.S. PATENT DOCUMENTS

| | | | | |
|---|---|---|---|---|
| 7,955,056 | B2 * | 6/2011 | Pettersson | G05D 16/2073 700/282 |
| 9,091,259 | B2 * | 7/2015 | Tamminen | F04B 23/04 |
| 9,181,953 | B2 * | 11/2015 | Steger | F04D 15/0066 |
| 9,382,903 | B2 * | 7/2016 | Ahola | F04D 15/0066 |
| 10,815,997 | B2 * | 10/2020 | Patwardhan | F04D 27/004 |
| 2003/0065423 | A1 | 4/2003 | Vanderbeek | |
| 2005/0278144 | A1 | 12/2005 | Zuercher et al. | |
| 2006/0257265 | A1 | 11/2006 | Pettersson | |
| 2008/0131258 | A1 | 6/2008 | Liepold et al. | |
| 2010/0178154 | A1 | 7/2010 | Dirks et al. | |
| 2011/0081255 | A1 * | 4/2011 | Steger | F04D 15/0066 417/44.1 |
| 2013/0287592 | A1 | 10/2013 | Kobayashi et al. | |
| 2014/0034009 | A1 | 2/2014 | Brinkmann et al. | |
| 2015/0220670 | A1 | 8/2015 | Linehan et al. | |
| 2016/0252091 | A1 | 9/2016 | Wagner et al. | |
| 2017/0016447 | A1 * | 1/2017 | Kosonen | F04C 28/08 |

FOREIGN PATENT DOCUMENTS

| | | | |
|---|---|---|---|
| CN | 103306896 | A | 9/2013 |
| CN | 106917742 | A | 7/2017 |
| KR | 101578827 | B1 | 12/2015 |
| WO | WO-2017/205584 | A1 | 11/2017 |

OTHER PUBLICATIONS

Murphy et al.: "Simulating Energy Efficient Control of Multiple-Compressor Compressed Air Systems", University of Dayton eCommons 2015—ecommons.udayton.edu.

Mousavi et al. : "Energy Efficiency of Compressed Air Systems", published by Elsevier B.V. https://doi.org/10.1016/j.procir.2014.06.026.

* cited by examiner

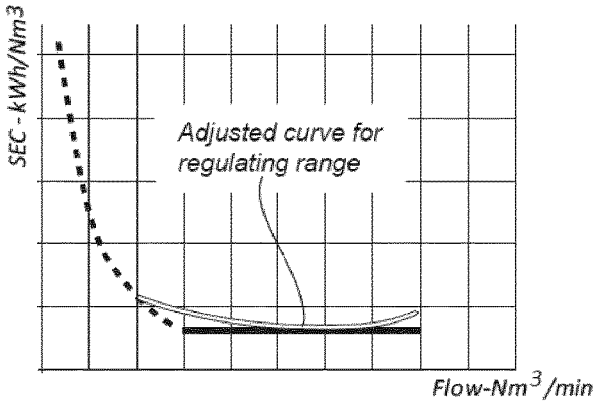
Fig. 2
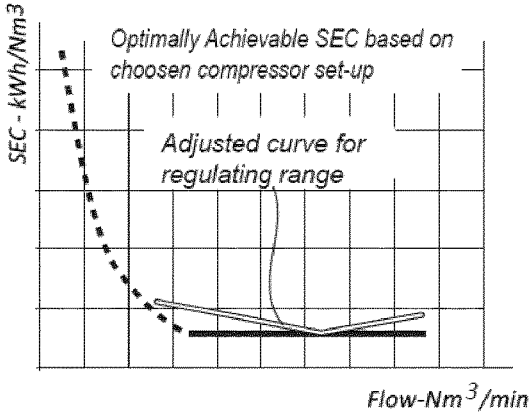
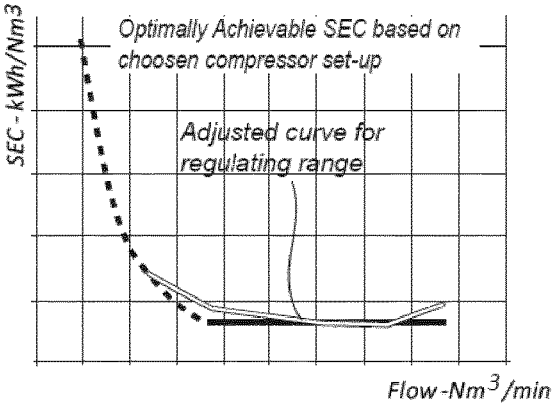

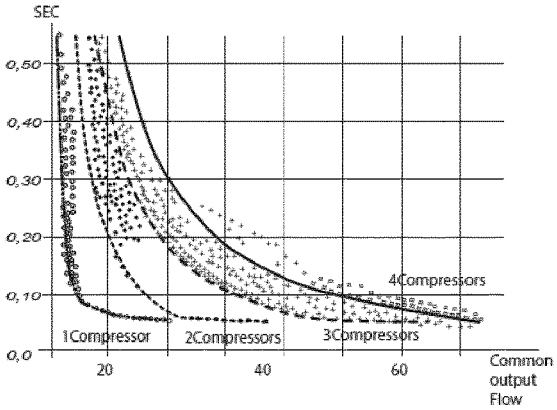
Fig. 8
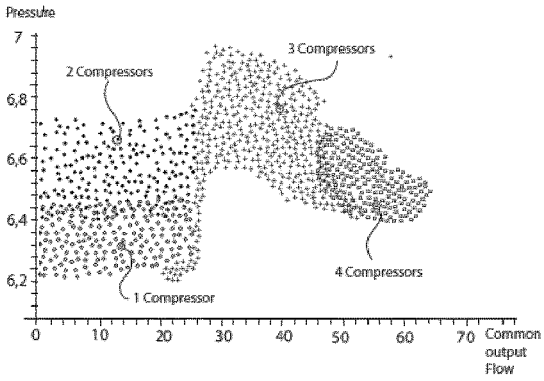
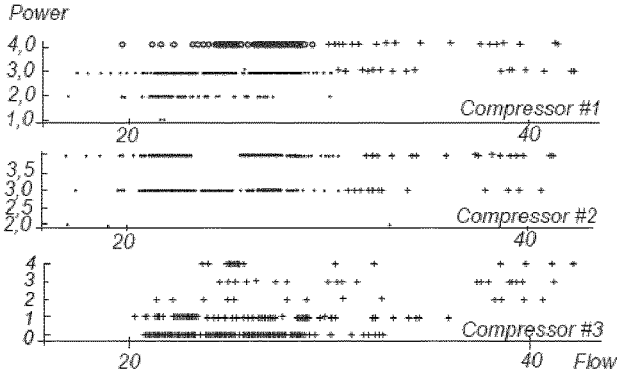

METHOD FOR ANALYZING, MONITORING, OPTIMIZING AND/OR COMPARING ENERGY EFFICIENCY IN A MULTIPLE COMPRESSOR SYSTEM

FIELD OF THE INVENTION

The present invention relates to a method for analyzing, monitoring, optimizing and/or comparing energy used for producing a unit of mass or volume of compressed gas (Specific Energy Consumption) in relation to a common output flow in a multiple compressor system.

TECHNICAL BACKGROUND

Multiple compressor systems are used in several industrial applications. Use of such and methods for controlling them are disclosed in several documents. To give one first example, in U.S. Pat. No. 5,108,263 there is disclosed a method of optimizing the operation of two or more compressors in parallel or in series. The method is directed to that the operating points of each pair of compressors are mutually and incrementally displaced without affecting the total operation parameters. The effect of the displacement on the total constraint is monitored and when the variation is occurring in the direction of optimization, it is continued in the same direction. Otherwise, the pressure that the operating points are displaced in is reversed. The procedure gradually shifts the compressors over to the optimal combination of operating points.

Secondly, U.S. Pat. No. 7,676,283 discloses a method for controlling a compressor plant having at least two compressor units, which method involves using an optimization calculation to calculate a new switching configuration from a current switching configuration of the compressor units.

Moreover, in EP0769624 there is disclosed a method and apparatus for load balancing among multiple compressors. The approach implies that the surge parameters, S, change in the same direction with rotational speed during the balancing process. The load balancing control involves equalizing the pressure ratio, rotational speed, or power when the compressors are operating far from surge. Then, as surge is approached, all compressors are controlled, such that they arrive at their surge control lines simultaneously.

Furthermore, there are also several other methods of controlling multiple compressor system disclosed in other patent documents, e.g. in U.S. Pat. No. 6,394,120.

Moreover, in the article "Parallel centrifugal gas compressors can be controlled more effectively"; Oil and gas journal; 1986, vol 84(44), pages 78-82 (Staroselsky N, Ladin L) there is disclosed both single compressor operation and multi-compressor operation. In the section relating to multi-compressor operation there is disclosed a case analysis of energy performance of 2 compressores with different strategies for unload and load of compressors simultaneously, unload and load of compressors in sequence as well as combining the simultaneous and sequential unloading.

The present invention is directed to a method for analyzing, monitoring, optimizing and/or comparing energy used for producing a unit of mass or volume of compressed gas (Specific Energy Consumption) in relation to a common output flow in a multiple compressor system. The method involves plotting real data and visualizing this data, enabling a user to perform an analysis of the systems operation and energy efficiency for optimization purposes.

Analyzing existing compressed air systems with the purpose of optimizing energy use, or prepare for making changes as well as designing systems from scratch poses many difficulties. A compressed air system is made up of many different parts installed by many different vendors with many mixed brands even for parts of the same type, compressors, etc. Detailed information of design or performance curves and similar is rarely provided by compressor manufacturers which make these tasks even harder.

Compressors are designed for different optimal pressures and it is not uncommon that a single multi compressor system consist of compressors of different type, regulation methods, manufacturer and design pressure.

SUMMARY OF THE INVENTION

The stated purpose above is achieved by a method for analyzing, monitoring, optimizing and/or comparing energy used for producing a unit of mass or volume of compressed gas (Specific Energy Consumption) in relation to a common output flow in a multiple compressor system, said method comprising:

- collecting measured data of common output flow and energy/power use and calculating the specific energy consumption in the multiple compressor system,
- identifying which data points of measured specific energy consumption that affiliate to a certain compressor or compressor combination in the multiple compressor system and/or operating mode(s) of the multiple compressor system; and
- plotting the data points of measured specific energy consumption that affiliate to a certain compressor or compressor combination in the multiple compressor system and/or operating mode of the multiple compressor system and marking affiliation of said data points to the certain compressor or compressor combination and/or operating mode.

The method as disclosed above is not hinted in any of the prior art documents shown above. For instance, in contrary to the article "Parallel centrifugal gas compressors can be controlled more effectively"; Oil and gas journal; 1986, vol 84(44), pages 78-82 (Staroselsky N, Ladin L), the method according to the present invention is directed to constructing the ideal specific energy consumption (SEC) curve(s) for any combinations of the compressors in question for the whole range of flow values in demand. Furthermore, the present invention involves creating a theoretical operation model for the multiple compressor system, which is not performed in any of the prior art documents mentioned above. Moreover, the method according to one specific embodiment of the present invention is directed to choosing the most optimal compressor combination(s) and their operational conditions, such as individual consumed power and generated flow to guarantee the best performance of a compressor system dynamically. This is yet another clear difference in relation to known methods.

According to one specific embodiment of the present invention, plotting the data points is performed in a chart of specific energy consumption vs common output flow. Furthermore, the method according to the present invention may involve that theoretical curves and/or measurement data points in any plots are linked to different compressor combinations, operation modes and/or transitions between different operation modes or compressor combinations and where the links are visualized by markings such as front- or background colors, symbols, separation into different subplots or similar to enable analysis of the effects of transitions and operating combinations in the multiple compressor system. These alternatives and more are further discussed below in relation to the description of the figures.

SPECIFIC EMBODIMENTS OF THE INVENTION

Below, further specific embodiments of the present invention are provided. According to one embodiment of the present invention, the method also comprises the steps of

- from a first compressor, constructing an ideal specific energy consumption curve in the first compressor as a function of the output flow of the first compressor; and
- from a first compressor and a second compressor, calculating a combined ideal specific energy consumption curve in the first compressor and the second compressor as a function of the combined output flow of the first compressor and the second compressor, and wherein the method comprises structuring calculated data to be visualized in ideal specific energy consumption curves, to analyze, monitor, optimize and/or compare with measured data for the corresponding multiple compressor system.

As may be understood from above, a multiple compressor system according to the present invention comprises at least two compressors, but may of course comprise several compressors. In this context it should also be mentioned that the expressions "first" and "second", and of course "third" and so on, if used, should not be seen as a specific order in the multiple compressor system, but instead an imaginary number to separate the different compressors in the multiple compressor system. As such, e.g. the third compressor of a certain multiple compressor system may be the smallest compressor in the system. So, the numbering is just an imaginary number and does not imply a certain order in the system with reference to position, size or something else. Fact is that the present invention may be used to understand the best order of operation for a certain multiple compressor system, implying that it gives insight of which compressor should be the first to set into production, which should be the second one used in combination with the first, or in systems comprising even further ones any type of combination(s), such as a second plus a fourth or a second plus a third plus a fourth, and so on. Moreover, the type of compressors involved may be of any type, in fact also certain pumps, such as pumps or systems with over outlet valves or over pressure valves and that are demand controlled, however the method according to the present invention is of special interest for gas compressors, e.g. air compressors.

The present invention has several advantages. Most multiple compressor systems are incorrectly dimensioned. Moreover, the regulation of multiple compressor systems is often far from optimized. These aspects render several issues which are solved or at least minimized by incorporating the method according to the present invention. The method provides visualization of measured data for a multiple compressor system, and as such provides a possibility for a user to change and optimize the system and its operation. The issues referred to above and visualized according to the present invention are systems and events thereof where the regulation is not operating as intended, incorrectly designing of systems and their dimension, control gaps thereof etc., and e.g. miscalculations of how real common output flow should be matched by best mode of compressor combinations and operating modes, the latter often implying the use of too many compressors and various unfavorable compressor combination.

Moreover, the method according to the present invention also makes it possible to simulate and optimize multi compressor systems with very high accuracy based on just a few parameters even when the pressure changes present in the system. The manufacturer often states a single efficiency performance number for their compressors as the specific energy consumption at the compressors optimal design point (ideal flow) at a certain fixed pressure. Together with the motor type plate nomination of motor size (typically in kW or hp) and knowledge of what type of regulating method that is used for a specific compressor, these parameters are enough to create specific energy performance profiles for compressors with very simple calculations as both optimal design point, regulating flow range, ideal Specific Energy Consumption and maximum possible flow at a certain pressure can be derived from the base data available.

Above and below, the expression "energy used for producing a unit of mass or volume of compressed gas" or "Specific Energy Consumption" is sometimes called SEC in the compressor industry, which, just to give an example, may be expressed in the unit kWh/$Nm^3$ or kWh/kg, or may be expressed as volume per energy unit, e.g. $Nm^3$/kWh (where $Nm^3$ means "normal cubic meter", i.e. the volume of gas produced at normal atmospheric pressure and standard temperature of 0 or 15° C.). Another alternative to specific energy consumption is specific power consumption (SPC or SP), which often is measured in the unit kW/($Nm^3$/min), and this and other equivalents may also be used according to the present invention. In this context it may be said that the expression specific energy consumption may refer to both power and/or energy/produced mass or volume unit and produced mass or volume unit/used energy unit or power unit.

Specific Energy Consumption varies with varying pressure but it is well known, throughout literature in the field of thermodynamics, that the effects of pressure changes on compressor efficiency can be estimated. One common method is by using a non-reversible polytrophic compression process to estimate the effect of a pressure changes on the compressors workload and thus its specific energy consumption. The proposed method according to the present invention may decouple the pressure effects from the operating model giving an advantage over other methods as the reference pressure for the model can be adjusted for, whether it is set as a constant or freely varied.

The expression "ideal specific energy consumption" should be seen as the specific energy consumption obtained in accordance with one possible model to use according to the present invention to compare possible system efficiency with measurement data of efficiency. With reference to an ideal specific energy consumption curve, the following may be explained: Every compressor or compressor combination and operational mode thereof has an ideal specific energy consumption curve, at a certain pressure level, i.e. for each total flow amount the ideal sec curve show the lowest attainable specific energy consumption at that pressure level. The ideal specific energy consumption curves may be adapted to realistic compressor systems by taking into account internal imperfections in compressor installation or control, or external variations in pressures or intake or outlet temperatures. A single compressor or combination of compressors can therefore have different ideal specific energy consumption curves depending on internal and external factors. Such ideal specific energy consumption curves can therefore also include simulated errors or faults. For example an operation mode from which an ideal specific energy consumption curve is generated could be including a faulty blow-off valve on one compressor leaking equivalent to being 10% open all the time.

In the majority of multiple compressor systems, output flow is driven by the demand, which may include leaks. Specific energy consumption, however, is dependent on compressor combinations and their regulating performance for any fixed output flow. The efficiency of a system is therefore decided by system/compressor operating parameters, configurations or combinations.

In the method according to the present invention the system can be optimized by changing these combinations, configurations and/or operating parameters based on analyzing measurement data. To be able to optimize a system, it must be analyzed and quantified. First it must be established if the system is running close to its ideal achievable efficiency and if the available system configurations are matching to the desired demand/output flow profile. The system may also run efficiently for some output flow ranges but not for others. The system may also show different behavior over time due to many different factors, one such being which compressors are made available (e.g. if some are manually shut off or on). With the present invention, collected measurement data is used to visually identify the efficiency performance of the system as well as providing disaggregation (classification of the measurement data in terms of well-defined categories based on compressor combinations and/or operating modes) giving the user an immediate view of how the system is operating in the different situations. The present invention may also use multiple plots in one or multiple dimensions and associated visualizations that tie the behavior of each individual compressor to operating situations. The present invention hereby gives the user a full view as well as a drill down on individual compressor level to enable a full analysis of cause and effect of the systems full operation as well as means to quantify the systems operational inefficiency. Based on this analysis the user then has the blueprint for implementing needed changes in individual compressor parameters as well as the optimal set-up and control strategy for the whole system and for all demand flow ranges. The user will then use the same analysis tool according to the present invention to follow up on any changes that is done to the system or compressor control parameters and/or system design changes for validation of the results as well as continuous monitoring of the system behavior and performance over time.

Ideal specific energy consumption curves constructed according to the invention may then be used as a reference towards the structured and disaggregated measurement data obtained through the analysis according to the method of the present invention to facilitate the user in the optimizing work as a point to point comparison of the achievable optimization target.

These ideal specific energy consumption curves may be seen as an optimal performance profile given a decided output flow range at a certain pressure. In the method according to the present invention, the ideal specific energy consumption curve is calculated for different combinations of compressors in the multiple compressor system. The ideal specific energy consumption curve for one single compressor is first calculated according to the present invention, for a specific pressure. Then, the combined ideal specific energy consumption curve for another combination with the same first compressor and also another compressor in the multiple compressor system is calculated for the same specific pressure. It should be noted that, the first as well as the second compressor may be any single compressor in a system comprising several compressors. Moreover, the combined ideal specific energy consumption curve may also involve one or more compressor(s) which is(are) in unload, i.e. pressurized standby with running motor but with no flow delivery (recirculation, closed air intake, etc. depending on compressor design). Furthermore, the method may of course also comprise constructing or calculating multiple combined ideal specific energy consumption curves of different combinations, such as for a first, a second and a third compressor together, or only a second and a third compressor together, or even more combined compressors, e.g. of which one or more are in an unloaded (standby) position. In this latter case, the ideal specific energy consumption curve(s) for any of the compressor combinations may be an ideal specific energy consumption curve based on an operating mode with at least one unloaded compressor. The simplest example is for two compressors, wherein either one of the two is in an unloaded mode.

Furthermore, the method may of course also comprise constructing the ideal specific energy consumption curves at different reference pressures.

The method according to the present invention provides how the different ideal specific energy consumption curves are dependent on the compressor's output flow, i.e. the operation model that describes how the system operates. As such, by constructing the ideal specific energy consumption curve in the first compressor as a function of the output flow of the first compressor the method provides means to determine how the ideal specific energy consumption curve in the first compressor is dependent on the output flow of the first compressor. Likewise, by constructing any other combination of compressors to provide the ideal specific energy consumption curve of that combination the method according to the present invention provides means to determine how the ideal specific energy consumption curve in that compressor combination is dependent on the output flow of said compressor combination.

Furthermore, the method according to the present invention may involve constructing/calculating and visualizing one or several ideal specific energy consumption curve(s) for compressor combination(s), in any combination(s). Furthermore, the method may comprise constructing/calculating the ideal specific energy consumption curve(s) for one or more fixed system reference pressure(s) substantially simplifying calculations and visualization as the model becomes independent of system pressure changes. Also, other less affecting variables, such as intake air temperature or pressure, may be taken into account. Moreover, according to yet another specific embodiment, the method involves constructing/calculating and visualizing the ideal specific energy consumption curve(s) for one or more fixed system reference pressure(s) and/or inlet conditions. Again, the method according to the present invention may be employed on any compressor combinations, such as a first plus a third compressor, a second plus a third compressor or a first, a second and a third compressor together, and so on.

According to yet another embodiment, the method involves constructing/calculating one or more ideal specific energy consumption curve(s) for multiple combined compressors, in any combination(s), and wherein at least one combination is based on combining adjustable flow ranges of individual compressors. Moreover, according to yet another specific embodiment of the present invention, the theoretical operation model is based on combing non-adjustable flow ranges and adjustable flow ranges for individual compressors separately to form one single virtual compressor. To combine non-regulating (non-adjustable) flow ranges and regulating (adjustable) flow ranges separately to stack and add the non-regulating flow ranges on top of each other first and then stack and add the regulating flow ranges on top of each other secondly is further shown in FIG. 4. It should also be mentioned that the present invention may be employed on multiple compressor systems with one or several compressors which are not possible to regulate, and where the different compressor sizes (flow capacity), and specific energy consumption curves are the parameters used to improve the mode of operation for a multiple compressor system. Moreover, it should also be mentioned that the ideal specific energy consumption curve(s) within the regulating flow range and the size of the regulating flow range is set according to models of a generalized compressor type, measurements on real compressors or manufacturer data.

A possible model employed according to the present invention may not only be affected in relation on non-adjustable and adjustable flow ranges of the different compressors, but may also be pressure adjusted to different reference pressures. Furthermore, according to one specific embodiment, the specific energy consumption curve(s) is calculated with specific energy consumption set as a constant within the compressor(s) regulating flow range and where ideal specific energy consumption curve(s) is calculated from a constant power use for the compressor(s) non-regulating flow range. Moreover, according to yet another embodiment, the ideal specific energy consumption curve(s) is adjusted for changes in efficiency within the regulating flow range. The adjustment in efficiency may be done with a standardized profile based on the position in the regulating flow range and based on the specific compressor type and regulating range.

The regulating flow range of compressors as well as the profile of the efficiency over the regulating range differ from compressor type to compressor type. The non-regulating flow range is typically defined by the fact that the compressor or compressed gas system activates one or more valves to relieve the system from the excess flow generated. These valves are usually named relief-valve, blow-off, blow-down, BOV, waste-gate valves or similar. These valves may blow out the excess generated gas in the free air or recycle it to the low-pressure side of the compressor or internally to any middle stages. The use of relief-valves induce a huge loss of compressor and/or system inefficiency as already compressed gas is wasted with the loss off all energy stored as a result of the depressurization.

The present invention may visualize and quantify use of regulating capacity, mismatches between regulating compressors and compressors in blow-off mode as well as other inefficiencies tied to specific compressor combinations and/or operating modes. The present invention may also tie these visualizations of how certain compressor combinations and/or operating modes relate to the constructed ideal specific energy usage curves as a mean to quantify the inefficiencies as well as visually presenting the current system operation status compared to the ideally achievable operation and provide information for optimization and/or further drill down to individual compressor level.

Common regulating methods used for compressor regulation is different types of inlet throttling (used for all types of compressors but most efficient in dynamic compressors such as axial or radial turbo compressors/centrifugal compressors). These different types go under different names, such as butterfly-valve, IGV or DVG. The present invention provides visualization of the system operation and behavior as well as the operation of a certain compressor combination and/or operating mode in such a way that the system's use and status of their regulating mechanisms can be easily understood. The invention may also provide a detailed visualization on the status or use of the regulating capacity on an individual compressor level.

Another common method with a very good efficiency profile that is widely used for all compressor types is regulation through speed control of the compressors motor. These are often named VSD, frequency drive or inverter drives.

Each combination of compressor type (screw, piston, turbo scroll etc. etc.) and control method creates its own characteristic specific energy consumption profile regarding regulating efficiency over the regulating flow range as well as the size of the usable regulating range. The regulating flow range also varies depending on pressure and compressor design.

Moreover, with most compressor types the total error with a simple model to use according to the present invention to compare possible system efficiency with measurement data of efficiency is below about 10%, which implies that already this level gives information to enable optimization, especially in the cases of compressors without regulation. Systems operating about 30-40% above optimal specific energy consumption is normally occurring.

Furthermore, according to yet another specific embodiment of the present invention, the ideal specific energy consumption curve(s) for every compressor is adjusted towards one or more constant pressure(s) in the multiple compressor system. In this case all specific energy consumption calculations are adjusted towards a reference pressure which is constant. This reference pressure may of course be adjusted.

The ideal specific energy consumption curve(s) may be calculated based on design curves employing measured or theoretical performance curves of the individual compressors in the multiple compressor system. Therefore, according to one specific embodiment of the present invention, the ideal specific energy consumption curve(s) is calculated employing design or performance curves of the individual compressors. The design curves of the individual compressors are based on the best operation mode ("sweet spot") for the individual compressors and/or by information from the manufacturer, or using generalized information well known in the field of compressors.

Furthermore, the operation model which may be used according to the present invention may also be adjusted based on time dependency so that time dynamic data is used. According to one specific embodiment of the present invention, the method and thus operation model involves compensation of the usable flow range for each compressor combination and operating mode based on the time dependency of each of the compressors when going from off mode to on mode, from unload (standby) to load (active or delivery mode), which are different operating modes, and/or the rate of change in flow rates measured or estimated in the multiple compressor system. Now, the model also takes into account the time needed to start and turn off individual compressors and also time needed to change flows based on the demand in the multiple compressor system. The characteristic time parameters can be initially set using the ab initio knowledge of similar compressors or their combinations, and later on precised via machine learning of the measurement data analysis according to the present invention.

The present invention may involve the steps of modeling and analyzing combinations of compressors and their efficiency over the flow range available for that combination. As the flow demand varies the required flow may increase beyond of what a certain combination can deliver. The compressor combination must then be changed into another combination which has the possibility to deliver the required flow. Such a transition from one combination to another with a higher capacity require additional compressors to be started. It may also involve starting several new compressors as well as shutting off compressors currently in operation.

The visualizations according to the present invention provide the user with full insight on the profile, behavior and implications and location of such transitions. The invention may also guide the user towards possible transitions to achieve a higher energy efficiency grade by the use of constructed specific energy curves as a reference towards transitions occurring in the current system. Using time dependency limitations of the usable constructed specific energy consumption curves the analysis may be further improved.

When starting a compressor there is a time delay before the compressor has gained enough speed and pressure so that it can be connected to the rest of the system. To give the compressor(s) enough time to reach a production state it is not possible to fully utilize the flow range of a certain combination of compressors to its maximum. The size of the limitation, e.g. non-usable flow range for a combination is determined by a combination of the speed of the changes in system flow demand as well as the time it takes to bring a compressor on-line.

Over-compensation of the needed switching point from one combination to another is a very common cause for decreased energy efficiency in a multi-compressor system and the present invention provides a new and precise tool to optimize this from an energy efficiency perspective.

The most common reason for discrepancies between measured curves and desired ones is inadequate regulation synchronization between different compressors or compressor groups causing compressors without regulating capabilities to go into blow-off or stand-by mode while there is still unused regulating capacity available from other active compressors. Another related fault in existing installations is not operating the regulating compressors at all or not using the regulating compressors within their regulating range in certain used combinations, which renders the system without regulating capabilities in that flow range. Such situations is easily identified by using the plotting of individual compressor energy use vs. total flow where such spare regulating capacity easily can be seen based on visualizing selected measurement data that has been associated to a single simulated operating mode.

To measure the individual flow from a compressor is quite difficult, however, to measure power is considerably easier. With the present invention, by only measuring total power and output flow as well as activity (mode of individual compressors) it is possible to classify and associate measurement points and constructed ideal specific energy curves to unique compressor combinations and/or operation modes of a multiple compressor system. In addition to activity, other measuring methods are possible according to the present invention, such as e.g. voltage/current, on/off signals, variable control signals, IGV and/or BOV values etc. It should also be mentioned that the power of a compressor is commonly measured indirectly in a sensor by measuring current and knowing or measuring voltage. The power is the product of voltage and current and may be output from the sensor as an analog signal. However, it is common that power is integrated to energy and that the sensor outputs pulses when a certain amount of energy has been consumed. In this manner, the power can be estimated.

As mentioned above, the present invention is directed to plotting the data points of measured specific energy consumption that affiliate to a certain compressor or compressor combination in the multiple compressor system and/or operating mode of the multiple compressor system and marking affiliation of said data points to the certain compressor or compressor combination and/or operating mode. This is a starting point of the present invention, but also many other plotting steps may be performed according to the present invention. According to one embodiment of the present invention, measurements of a common system pressure vs the total common output flow is plotted in a separate plot and/or pressure is plotted as an additional axis a multi-dimensional (3D) plot together with the measured specific energy use and common output flow. A stable pressure is a very important parameter in a compressed air system, especially to obtain a good energy efficiency. With a separate plot as disclosed above, the energy efficiency is linked to pressure/pressure volatility, implying that the effect of the operation (compressor combination/mode) of the compressors on the pressure may be analyzed. This is for instance of great interest when measured data points are marked dependent on the compressor combinations.

Moreover, according to yet another embodiment, measured and/or known states of compressors, voltage on/off, software or hardware controlled compressor switches and/or gas flow from particular compressors are used to affiliate a measurement point to a certain compressor or compressor combination and/or operating mode(s) in the multiple compressor system. Furthermore, according to yet another specific embodiment of the present invention one or more data points having a higher measured specific energy consumption than the ideal specific energy consumption curve for that compressor combination and operating mode is used to indicate that system regulation can be optimized and/or used to select the relevant data points for further analysis. According to the present invention it is thus also possible to see what is causing the inefficiency, for instance by selecting certain points/transitions and then see which states (operation modes) that different compressors have, which compressor combination that are involved at a certain state and the regulation or reaction of different individual compressors. Moreover, according to yet another embodiment, one or more data points associated to an ideal specific energy consumption curve is compared to another(other) ideal specific energy consumption curve(s) with another(other) compressor combination and/or operating mode(s) that can produce the same common output flow to indicate if there is a more efficient compressor combination and/or operating mode available for the system operation. Also in this case selection and highlighting of measured data points may be used to differentiate inefficiencies caused by regulation errors from inefficiencies caused by inaccurate compressor combinations/operation modes.

Moreover, according to yet another specific embodiment, the difference between data points of measured specific energy consumption and ideal specific energy consumption curve(s) are summarized and/or averaged over time to create key performance indicators of the system's inefficiency. Such Key performance indicators can also be separated for different common output flow ranges or other suitable classifications. The inefficiency may be related to too high specific energy consumption of the system due to the transition between different compressor combinations or operating modes occurring at a sub-optimal point of flow or not occurring at all. The inefficiency may also be related to one or more data points having a higher real measured specific energy consumption than indicated by the relevant ideal specific energy consumption curve for a certain flow.

Furthermore, the differences between data points of measured specific energy consumption and common output flow compared to ideal specific energy consumption curves may be used to detect these inefficiencies in the compressor system, such as settings that are not correctly set on individual compressors, transition points between different compressor combinations, system design flaws or defect equipment. Moreover, these differences between data points of measured specific energy consumption and common output flow from real compressors may be compared to ideal specific energy consumption curves to detect errors in the measurements, such as wrong conversion factors, sensor errors or missing data.

Furthermore, the present invention is also directed to a method wherein measurement data points of energy consumption, activity and/or other compressor regulating parameters or measurement values from individual compressors are plotted in one or more separate plots with reference to total common output flow and/or system pressure and/or specific energy consumption in the multiple compressor system to identify the pattern of operation for each individual compressor in the multiple compressor system.

Moreover, the method according to the present invention may also involve including visualization of operating mode for each compressor in the multiple compressor system to indicate whether the compressor is on/off and/or load/unload and/or within/outside regulating range or other compressor specific parameters or operating modes.

Also the dimensional perspective may vary with reference to the plotting according to the present invention. According to one specific embodiment of the present invention, the method involves calculating and visualizing the ideal specific energy consumption curve(s) together with measurement data, wherein ideal specific energy consumption curve(s) are adjusted to one common pressure for all compressors in the multiple compressor system and wherein ideal specific energy consumption curves are then plotted in 2D for a chosen pressure, or wherein ideal specific energy consumption curve(s) are plotted in 3D with a variable common pressure to visualize also pressure dependency and/or where measurement data and ideal curves are adjusted towards the same inlet conditions. Furthermore, according to yet another embodiment, the method involves calculating and visualizing the ideal specific energy consumption curve(s) together with measurement data, wherein measurement data of flow and power/energy consumption is pressure adjusted to the same pressure that has been used for calculating the ideal specific energy consumption curves and then plotted in 2D together with the ideal specific energy consumption curves, or wherein ideal specific energy consumption curve(s) are plotted in 3D with a variable pressure axis and where the measurement data is plotted in the same 3D plot using the real pressure for each measurement point and/or where measurement data and ideal curves are adjusted towards the same inlet conditions.

Moreover, according to yet another embodiment at least two ideal specific energy consumption curves are aggregated into one common reference curve that is visualized in 2D for a common pressure or pressure adjusted towards a variable pressure and visualized in 3D.

In this context it may also be mentioned that a possible standard model according to one embodiment of the present invention may be pressure dependent. In many compressor systems, it is desirable to avoid varying pressure, and then the reference pressure ("working pressure") is used for the entire system to analyze specific energy consumption and flow. As mentioned above, however, this reference pressure may be varied when testing in simulations. Varying pressure might be because of requirements or because the system cannot maintain a stable pressure for whatever reason. It is possible to have varying pressure so that also the pressure dependency is reflected in each measurement point, such that specific energy consumption, pressure and flow are analyzed together. The three quantities can be plotted in 3D plots, one or more of the quantities can be attributed with a color scale, different symbols or similar as well as plotting the pressure dependency in a secondary plot liked to the other plots.

Furthermore, according to yet another embodiment, the individual ideal specific energy consumption curve that will form a part of the common reference curve is selected by choosing the curve that has the lowest specific energy consumption for that flow range based on all available compressor combinations and operating modes. Moreover, the data of ideal specific energy consumption for one or several common output flow rates for multiple compressor combination(s), in any combination(s), may be combined individually, structured and plotted in ideal specific energy consumption curves, and wherein the method involves combining ideal specific energy consumption curves to establish and/or measure control gaps based on lack of overlap of the regulating flow range between different ideal specific energy consumption curves.

A control gap implies a flow range where the system, and the possible combination of compressors, has no regulating (adjusting) capacity. These areas may imply a high specific energy consumption and also a risk of system interference in the form of pressure fluctuations, and therefore it is of interest to avoid such. Such areas may be identified according to the present invention by using constructed ideal specific energy curves to analyze if adjustable flow ranges in different compressor combinations are overlapping each other or not (see FIG. 6). This may be performed with or without time dynamical analysis as discussed above. Moreover, also when comparing with real measurement data, this approach may be used to identify if there are existing flows where control gaps may occur as well as analyzing the effect these have on pressure and pressure volatility.

Moreover, according to one specific embodiment, levels of energy(power) for maximum energy(power), off position, standby position, regulation range, position of lowest specific energy consumption and/or other critical compressor performance values are marked in the compressor energy (power) charts. Furthermore, according to yet another embodiment any pressure, flow, power(energy), specific energy measurement data or other measurement from the multi compressor system is plotted vs. time and where each measurement point is linked to different compressor combinations, operation modes and/or transitions between different operation modes or compressor combinations and where these are visualized in the plots (s) by markings such as front- or background colors, symbols, separation into different sub-plots or similar to enable analysis of the effects of transitions and operating combinations in the multiple compressor system.

Furthermore, according to one specific embodiment, the measurement data points are binned and/or grouped in separate ranges and visualized as contour plots, heat maps, histograms or similar plotting techniques instead of plotting individual measurement points separately. This feature according to the present invention also enables to visualize great amounts of data, e.g. several months or years, to find deviations and changes in the system over time. Moreover, identified control gaps may be marked with color, different front- or background color, limit lines, symbols or similar in any of the aforementioned other plots.

Moreover, according to yet another specific embodiment, the method involves calculating the usable flow range for each compressor combination and operating mode based on the time needed to create an increase or decrease in the common output flow by changing from one compressor combination or operating mode to another in relation to the measured rate of change in flow in the multiple compressor system and marking the usable and/or non-usable part of each ideal specific energy consumption curve in the ideal specific energy consumption vs common output flow plot(s). The method may also involve calculating the usable flow range for each compressor combination and operating mode based on the time needed to create an increase or decrease in the common output flow by changing from one compressor combination or operating mode to another, in relation to the rate of change in measured flow in the multiple compressor system as well as calculating the most efficient compressor combination or operating mode to switch to, and marking the flow point for optimal switching from one compressor combination or operating mode to another.

Furthermore, according to one specific embodiment of the present invention, the analyzing method involves selecting one or more measurement points either individually or with one or more polygon area(s) or volume (s), wherein the corresponding measurement points that have been selected are marked or otherwise identified with highlighting, color, symbols or similar effects in any of the other visualization plot(s). According to the present invention and using such methods and features it is possible to further isolate different "events" and how these are linked to the behavior of individual compressors and the behavior of the system in its whole. One example is how the time aspect occurs at a shift between different compressor combinations/operating modes based on the measured data.

The method according to the present invention may be employed for both compressors and certain pumps, such as the ones mentioned above. According to one embodiment of the present invention, the multiple compressor system is a compressed gas compressor system and the compressors are compressed gas compressors. To give some possible applications of interest, just as examples, there is natural gas distribution or industrial compressed air (cylinders, pneumatic devices, purging, compressed air for $N_2$ and/or $O_2$ generation etc. etc.). Again, any type of compressor is possible according to the present invention. Compressed air compressor systems are one specific type of great interest in relation to the present invention. Moreover, both open loop and closed loop systems are possible according to the present invention. An open loop system is a system where gas is ejected decompressed into the atmosphere after use. Typical examples are compressed air systems. Closed loop systems are such where the used gas is recirculated into the compressor intake after usage. Typical examples are refrigeration systems and heat pumps.

Furthermore, the present invention is also directed to a computer unit arranged to perform the method according to the present invention, wherein said computer unit is arranged to structure and visualize data.

DETAILED DESCRIPTION OF THE DRAWINGS

Below, the drawings are described.

In FIG. 1, is shown a schematic view of a multiple compressor system with common output flow. In this case there are three different compressors in the system. The compressors are regulated individually, and the total input power is divided accordingly over the different compressors. A multiple compressor system provides one common output flow regardless if this is directly in one mixing point subsequently to the compressors or if this is e.g. after a common expansion tank.

The compressors may be connected to a ring-line or distribution line and the flow may be split into different end-usage areas in a way that there is no single measurement point where all the combined flow from all compressors passes. The combined end-usage is then the common output flow. The common output flow must then be measured as an aggregated flow from individual measurements throughout the system and/or over the distribution network.

Any compressor system where there at some point in the system is an interconnection between the compressors enabling a cross-flow can be considered as a multi compressor system with a common output flow. It is also common that the air flow from the compressors may be directed in such a way that there are losses of air from certain compressors from e.g. air dryers that are only connected to part of the compressors. The losses occurred in such a process will then be a part of the total output flow (and/or compensated for in the performance adjustments). Such losses can either be measured or calculated from models and/or other parameters such as pressure. One such example is compressor units sold with an integrated dryer unit which may be connected into a system with compressors with external air dryers and where the air from the two types is mixed after dryers.

In FIG. 2 is shown further embodiments according to the present invention. In the different cases the profiles in the regulating flow range for a certain compressor set-up are adjusted in accordance as shown in the figures of FIG. 2. The adjustment may be performed with one or more linear compensations, with a mathematically adjusted curve or with a curve based on some decided points (see the last alternative).

With reference to FIG. 2, there are several parameters which is of interest to calculate or know. Firstly, specific energy consumption (SEC) at 100% output flow. Secondly, specific energy consumption at an optimal output flow, i.e. the minimal specific energy consumption, as well as the optimal output flow in percentage. Finally, specific energy consumption when the regulation starts, as well as the output flow, in percentage, when the regulation starts. If more data is available, this is of course beneficial. The upper curve to the left is in the shape of quadratic curve, and may e.g. be any type of n-degree polynomial curve. Also other types are possible, such as Gauss curve, Bézeir curve or other form of parametric curve, cos- or sinus curve. The curve down to the left is two first order curve. In this case, any type of piecewise functions where the function is divided into different flow ranges. Finally, the curve down to the right is also a variant to a piecewise function where an assumption has been made so that the flow ranges are about the same size. This is one possible assumption, but many others are also possible.

Figure 3:
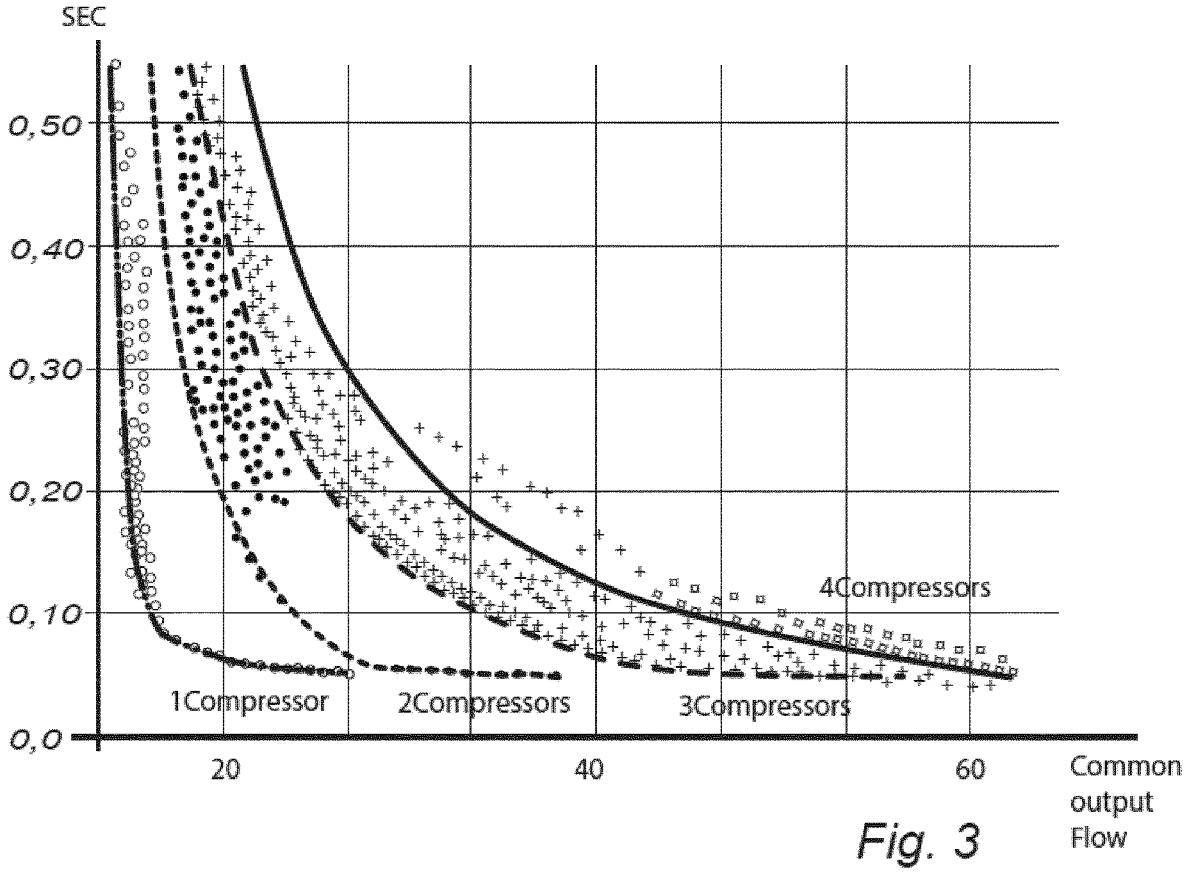

In FIG. 3 is shown the system measurement data of specific energy use and common output flow classified into different compressor combinations which are visualized with different symbols in the plot. The combined ideal specific energy consumption (SEC) curves according to one embodiment of the present invention that are matching the plotted compressor combinations has also been plotted into the graph. As may be noted, the first curve to the left is the ideal specific energy consumption curve of one compressor. This "first" compressor may be any compressor of the multiple compressor system, when being the only compressor in operation. As described above, the ideal specific energy consumption curve of this first compressor is calculated as a function of the output flow of the first compressor, and then plotted. The next curve is a combined ideal specific energy consumption curve of a first compressor and a second compressor, in a general context this could be any two compressors of the system. Accordingly, the last curve shows the combined ideal specific energy consumption of three compressors in sequential operation, i.e. 1, 1 plus 2, 1 plus 2 plus 3 as derived from the combinations used in the plotted measurement data. This example is of two non-regulating screw compressors and one frequency regulated screw compressor. The measured data points are from 4 different compressor combinations. I.e. 1 compressor, 2 compressors, 3 compressors, and 4 compressors are plotted with different symbols and are overlaid with the four corresponding ideal specific energy consumption curves matching the different compressor combinations. It should be noted that also curves of unloaded combinations may be constructed and visualized as well as measurement data for unloaded combinations may be marked with different symbols. As notable, most real measurement data points are not on a (SEC) curve that would provide the lowest possible specific energy consumption for a certain flow. Furthermore, many measurement points are not directly on or in close proximity to the (SEC) curves but are present at a higher specific energy consumption than if they would have been on the ideal (SEC) curve which further shows improvement opportunities for operating this specific multiple compressor system in a much more efficient way than it is performed today. The figure shows that the system as measured operate at close to optimal efficiency only in the highest flow range and while operating four compressors.

Figure 4:
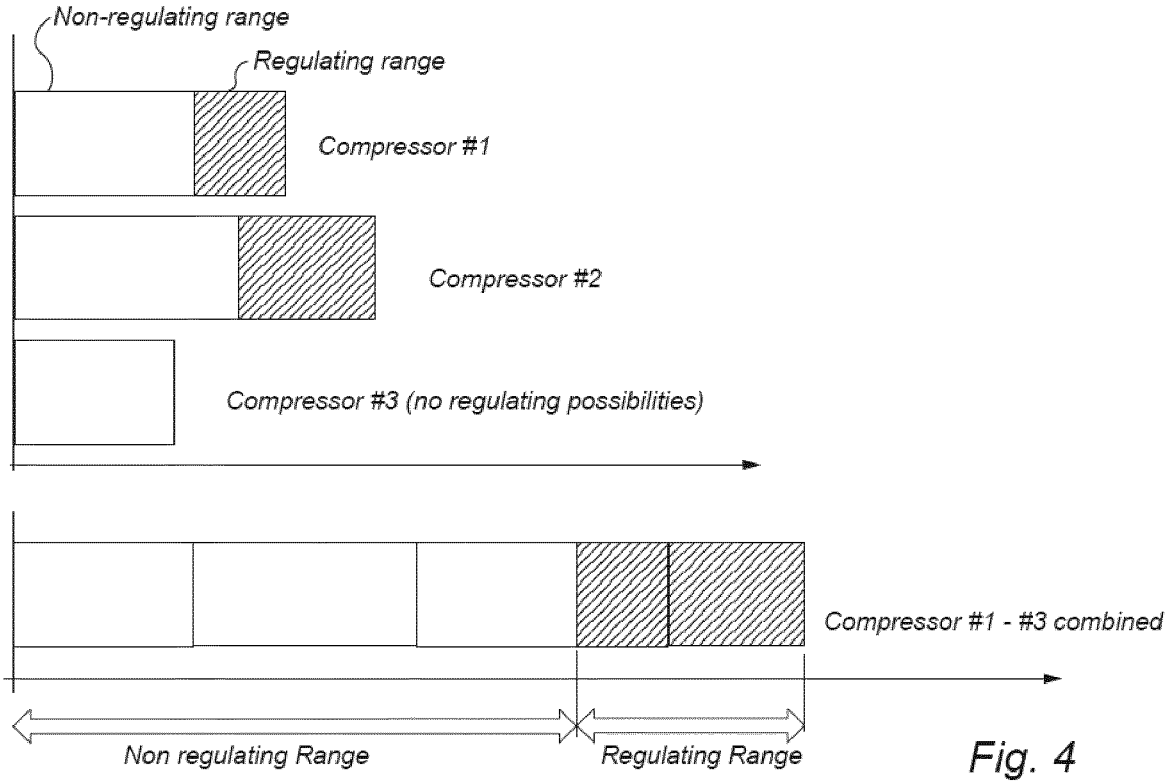

In FIG. 4 is shown a model according to one specific embodiment of the present invention. The non-regulating flow ranges and regulating flow ranges in relation to flow for the individual compressors are shown firstly. According to one embodiment of the present invention, the theoretical operation model is based on combing non-adjustable flow ranges and adjustable flow ranges for individual compressors separately to form one single virtual compressor. This single virtual compressor is shown below where one may see how the different parts of the individual compressors have been added to form the virtual compressor. As such, this embodiment provides one single virtual compressor with one non-regulating flow range and one regulating flow range in relation to the total flow as a model to use when evaluating a multiple compressor system. The FIG. 4 shows the regulating flow ranges of two compressors being modelled in sequential order so that only one compressor is regulating at a time and the next compressor starts regulating as soon as the previous compressor reaches its regulating flow range limit. The regulating flow ranges of the combined compressor may also be modelled as regulating in parallel over the common regulating flow range or a combination of sequential and parallel. Compressors regulating in parallel would be simultaneously regulating throughout their entire common regulating flow range.

Figure 5:
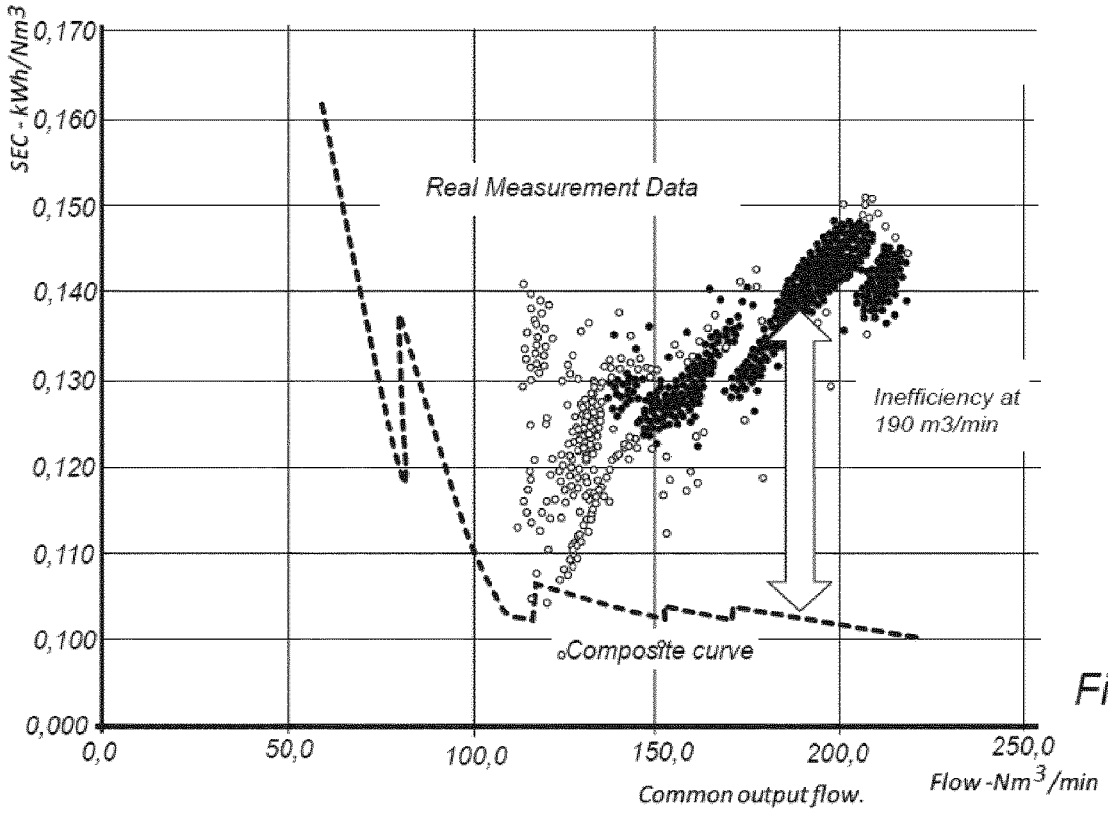

In FIG. 5 is shown one specific embodiment according to the present invention, in which at least two ideal specific energy consumption (SEC) curves are aggregated into one common reference curve (called composite curve in FIG. 5). Moreover, real measurement data from two different compressor combinations has been plotted into the graph and based on this the inefficiency measured in delta specific energy consumption at a certain system flow may be calculated. The individual ideal efficiency curves may also be adjusted before aggregation based on reduced regulating flow ranges taking system dynamic time constraints into consideration.

Figure 6:
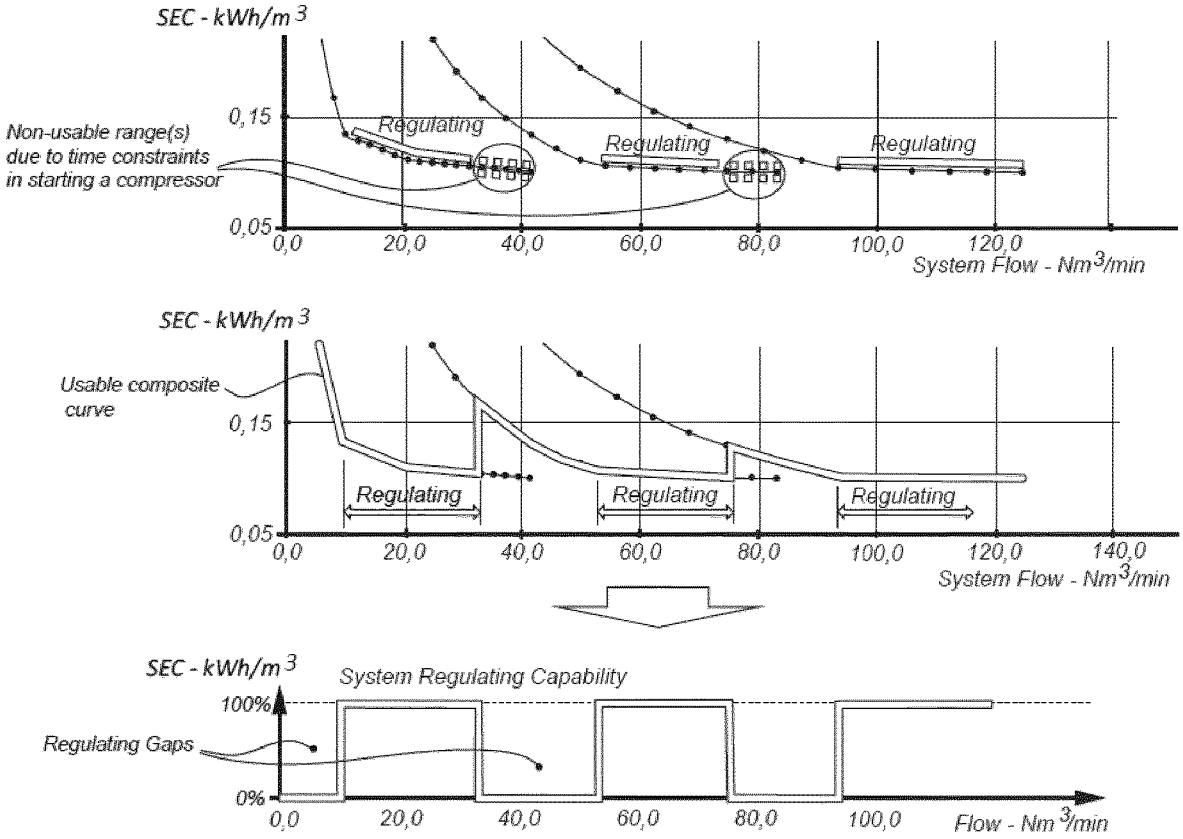

In FIG. 6 is shown three plots of ideal specific energy curves from a three compressor system comprising of one VSD screw compressor and two load/unload type of screw compressors all with similar sizes. The two upper plots show SEC ($kWh/Nm^3$) vs common output flow ($Nm^3/min$) and the bottom plot show the systems regulating capacity for different common output flows.

The uppermost plot shows the available regulating ranges of the different compressor combinations (1, 1 plus 2, 1 plus 2 plus 3) and the non-usable part if the regulating range is marked separately. The non-usable part of the regulating range has been set by taking account of the systems desired capability in handling fast flow changes as well as the needed start-up time for an individual compressor.

The middle plot shows the aggregated ideal specific efficiency curve constructed from the three separate ideal specific energy curves for the three different compressor combinations. The non-usable part of each curves regulating range has been excluded while performing the aggregation. The bottom plot shows a visualization of where the regulating gaps for the system is present based on the aggregated curve shown in the middle plot. 100% on the y-axis show that the system has full regulating capability and thus can operate efficiently and stable. 0% on the y-axis show that the system lack regulating capability for those flow ranges and thereby indicates the position of the systems regulating gaps.

Figure 7:
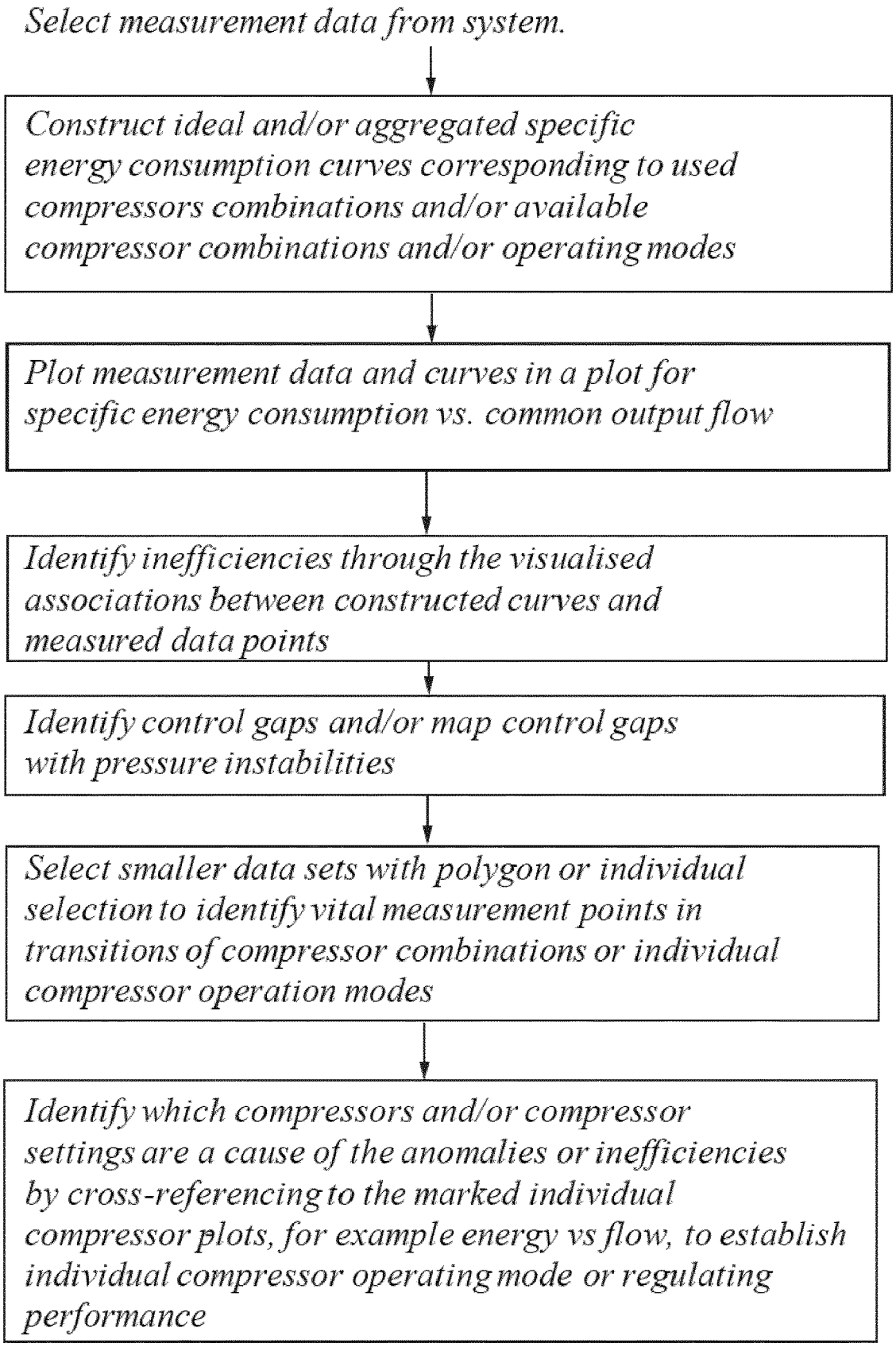

In FIG. 7 is shown a schematic view of a method and the steps therein according to one embodiment of the present invention.

In FIG. 8 is shown five separate linked plots for a four compressor system according to one embodiment of the invention where the individual measurement points for each detected compressor combination is identified with a unique symbol. The upper plot shows measured SEC vs. common output flow, the lower left plot shows system pressure vs. common output flow and the lower right triplet plots show individual compressors energy usage vs. the common output flow for three of the system's compressors.

Figure 9:
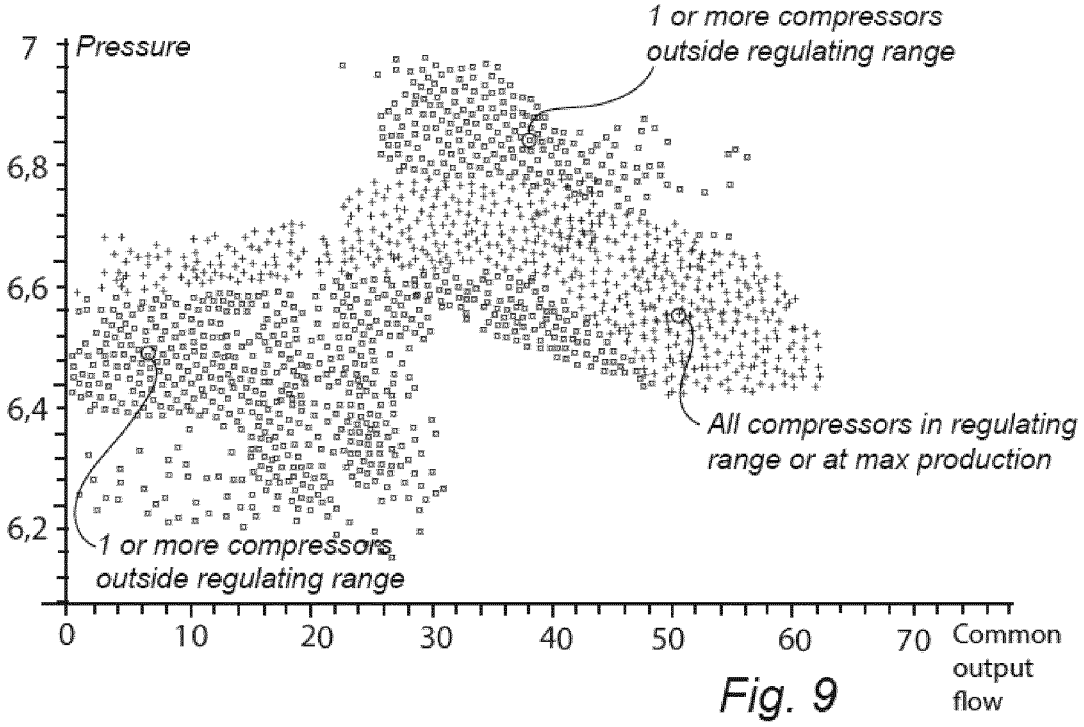

In FIG. 9 the pressure vs common output flow for a multi compressor system is plotted and the individual measurement points are identified in two different categories depending on whether all compressors are working within the regulating range or if one or more compressors are operating outside their regulating range, i.e. with an open blow-off valve and thus in a less energy efficient state. The plot is used as a supplementary plot to other plots as described in the description herein and the same classification and marking can be used in any other plot such as specific energy vs. common output flow. It can also be part of a larger multi-dimensional (3D) plot.

Figure 10:
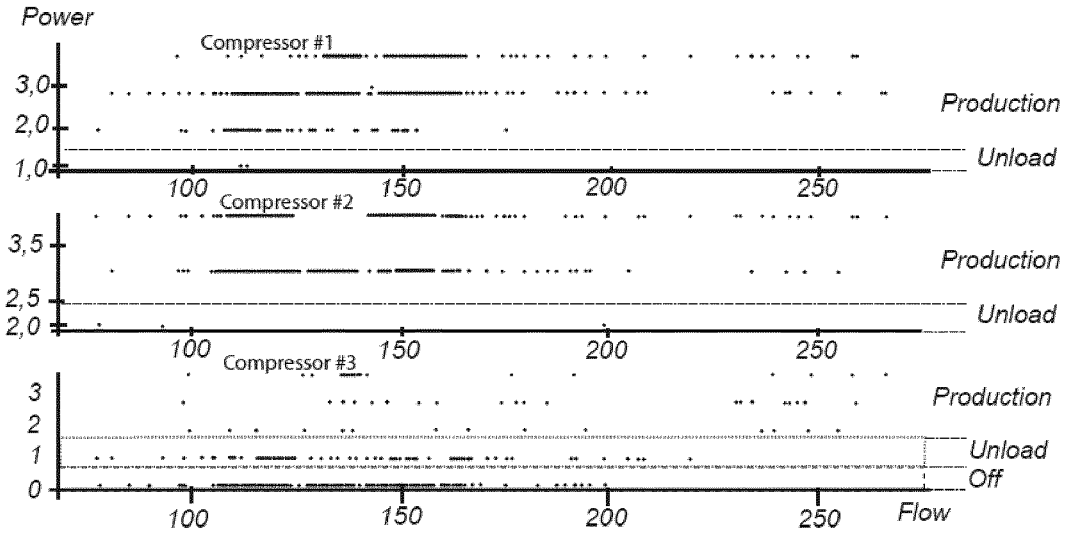

In FIG. 10 three plots are shown where each plot corresponds to an individual compressors energy usage vs. common output flow. The charts are segmented in the Y-axis direction and marked in different areas depending on the compressor operating mode present in the specific energy usage range.

The areas used in the three plots are "production" which corresponds to the compressor contributing to the common output flow, "Unload", where the compressor is in unloaded state and does not provide any contribution to the common output flow and finally "Off", where the compressor is completely shut down. There are many different options of area classifications that can be used such as separation of the production range into smaller segments and/or presentation of expected IGV position.

Figure 11:
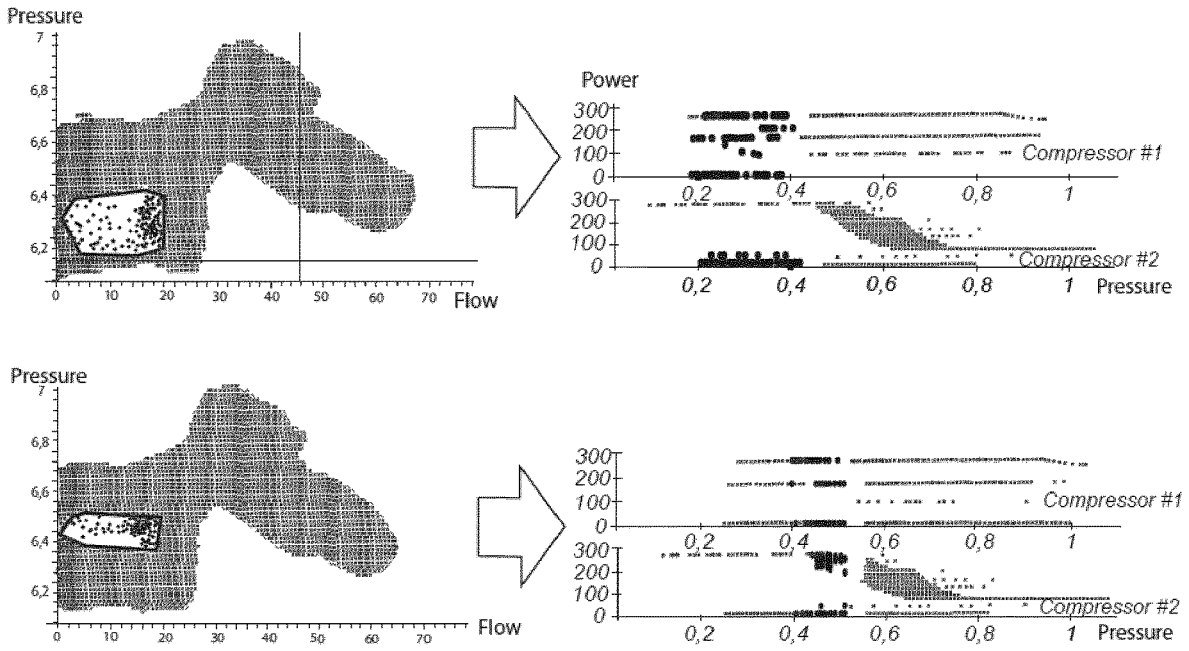

In FIG. 11 it is visualized how a sub-set of the collected measurement data is selected in a pressure vs. common output flow plot through the use of a polygon selection according to the present invention and where the corresponding measurement points to the selected ones are highlighted in a secondary plot. This selection procedure and highlighting can be used on any of the in the invention mentioned plots and the highlighting can be implemented in any of the plots and in any number of plots simultaneously. The selection can also be further refined through selecting an even smaller sub-set of the previous selected points using the same polygon tool or by selecting individual measurement points.

Figure 12:
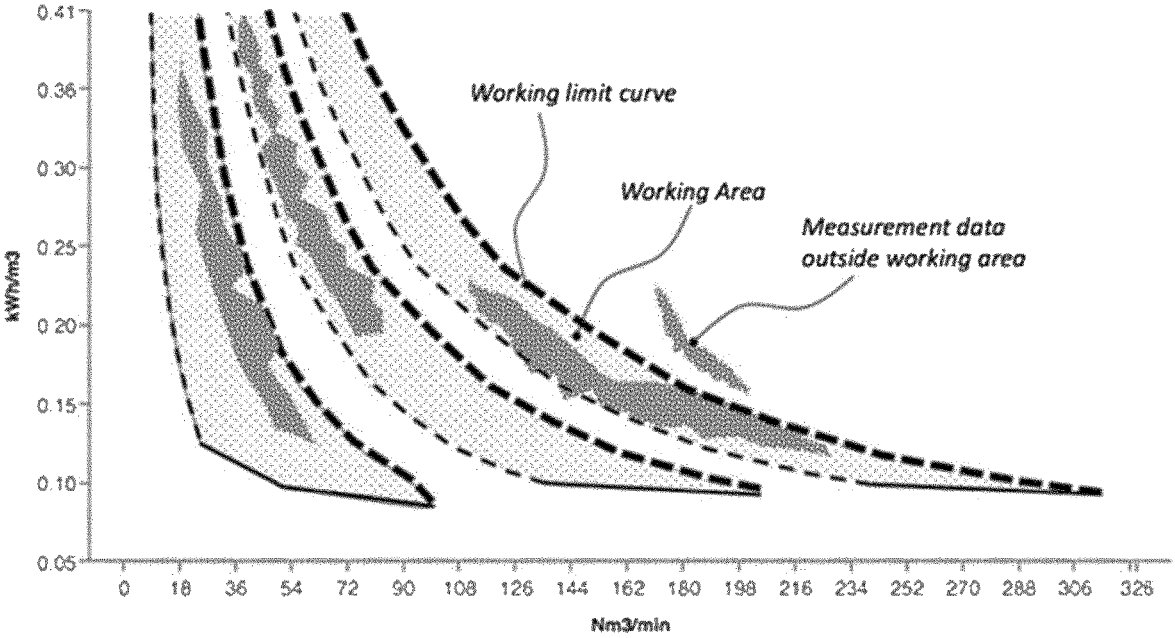

In FIG. 12 there is shown plots of a multiple compressor system in accordance with FIG. 3 and in this case comprising 3 compressors in 3 different compressor combinations. In these cases, all the created ideal specific energy consumption curve(s) are complemented with another type of curve. This complemented curve sets the working limit for each certain compressor or compressor combination in the multiple compressor system. As may be seen in extra Fig. A, these curves are plotted using the maximum flow of each compressor combination and from this plotting a curve assuming none if the compressors used in the combination is using any of their regulating capacity whereas the energy use remains constant or close to constant for any flow. The curve is thereby constructed in the same way as an ideal curve for a compressor combination that does not include any compressors with regulating capabilities. In FIG. 12 it is shown that a working area is created by combining an ideal specific energy consumption curve with this complemented working limit curve. As such, data points found outside of the working area may be identified and indicated as measurement errors and/or system/compressors faults.

Based on the above, according to one specific embodiment of the present invention, the ideal specific energy consumption curve(s) is plotted and each of them is complemented with another curve visualizing the working limit for each certain compressor or compressor combination in the multiple compressor system, and wherein the curves together form a working area for each certain compressor or compressor combination in the multiple compressor system. Furthermore, according to yet another specific embodiment of the present invention, data points outside of the working area(s) for each certain compressor or compressor combination in the multiple compressor system are identified and/or indicated as measuring errors or system or equipment faults. Moreover, and as hinted above, according to yet another embodiment of the present invention the working limit curve is constructed and plotted in the same way as an ideal specific energy consumption curve but assuming that none of the compressors involved in the compressor combination is using any of their regulating capabilities.

CONCLUSIONS

The present invention provides a model for analyzing an existing multiple compressor system to find the optimal operation mode based on real measurement data.

The method according to the present invention may be directed to different types of usage. For instance, the method may be directed to regulation of a multiple compressor system as such. Moreover, the operation model according to the present invention may also be used only as a simulation model or mathematical model for analyzing an existing multiple compressor system. By use of the model as such, a multiple compressor system may be evaluated and improvements may be implemented. Furthermore, this also implies that the operation model according to the present invention may be used as a type of virtual multiple compressor. Regardless, the main direction of the present invention is a modelling method, implemented directly into a multiple compressor system or used indirectly off-site only on collected data.

The present method is directed to visualize ideal specific energy consumption curves for different compressor combinations and operating modes in the multiple compressor system. This is different when comparing to other existing systems today. Moreover, another clear difference is the fact that the present invention provides both disaggregation and visualization of measurement data into different compressor combination, operating modes, individual compressor operation and system pressure as well as direct comparison of the measurement data with simulated system performance. Other known methods, are limited to comparison only with static reference levels of specific energy usage and/or time average/accumulated key performance indicators, whereas the invention enables the use of key performance indicators measuring efficiency while at the same time taking ideal system performance into consideration thereby providing a much more accurate measurement and base for further analysis. Other known methods are also limited to plotting the systems measured or calculated values in time based plots or in some cases in flow profiles (i.e. histograms), and thereby not providing the analyzing user with any associations between the measured data and the systems operational mode and thereby severely limiting the possibility to find the causes of problems and in many cases to identify the existence of the problems or inefficiencies altogether. The possibility to analyze the system in a time independent manner enable analysis over long periods of time as well as the possibility to compare with an operational model that is directly associated to the data to provide the user with advantage over other available analyzing methods.

To summarize, the method according to the present invention has several advantages in comparison to existing analysis methods for compressed air systems and other multiple compressor systems. Firstly, it provides disaggregation and association of the measured data into unique compressor combinations and system operating modes, enabling identification of problems as well as visualizing the cause. Secondly, real data may be compared directly to a simulation model matching the associated data enabling identification of improvement potential as well as possible improvements to the system set-up, control or operation. Moreover, the present invention provides the tool for a full analysis of an existing multiple compressor system without the need of deep expert knowledge and skill through indication and visualization of both inefficient or unstable operation as well as means to visualize and find the causes and also indicate the possible solution by comparing with simulation of optimal system operation.

To give a guidance of the possible level of improvement when using the present invention, a possible value of specific energy consumption as $kWh/Nm^3$ at around 0.09 or 0.1 in the widely used pressure band of 6-8 bar may be obtainable using large size screw or turbo compressors, which may be compared to a level of anywhere from 0.15 and upwards which is a common level for a reference multiple compressor system running without proper optimization and/or regulating capability. To lower the specific energy consumption value of this magnitude is of course of great interest. To simplify the process so that non-expert users can perform such system optimizations as well as providing expert users tools to find further earlier unrealized optimization potential is also of great value.

As described above, measured data of common output flow and energy/power use can be collected using different types of sensors, e.g. the power of the compressor can be measured by measuring current and measuring voltage, if not being set at a constant value. By continuously collecting data related to the common output flow of energy/power use as well as determining, or in other words calculating, the specific energy consumption in the multiple compressor system, it is made possible over time to collect data that can be used for increasing the understanding of how to control the system in an energy efficient manner.

Further, it can be identified which data points of measured specific energy consumption, collected by using the sensors, that affiliate to a certain compressor or compressor combination in the multiple compressor system and/or operating mode(s) of the multiple compressor system. Put differently, a specific data point can be associated with the compressor or compressor combination used when the specific data point was collected as well as the operating mode(s) the compressor or compressor combination was set to when the data point was collected. Information of the compressor or the compressor combination used when collecting the data point can be retrieved from the compressors themselves or alternatively from a control unit connected to and controlling the compressors.

Time stamps may be used for affiliating the data points to the compressor or compressor combination as well as the operating mode. When measuring the common output flow and energy/power a time stamp may be added to the measured data. In a similar manner, a compressor or compressor combination being used, as well as the operating mode being used, may be logged with a time stamp. By having time stamps both for the measured data and the compressor and compressor combination, as well as operating mode(s), it is possible to affiliate these to each other.

Having data points collected over time from the compressors and having these affiliated with different compressors or compressor combinations, and also to different operating mode(s) it is made possible to analyze, monitor, optimize or compare different alternatives for producing a unit of mass or volume of compressed gas (Specific Energy Consumption) in terms of energy used. This can be achieved in different ways. For instance, data points related to a specific alternative may be color coded such that when the data points are presented to the user, sometimes also referred to the operator, the different alternatives can be easily kept apart. Still an option is to configure a computer, or a control unit, such that based on the data points a most energy efficient can be chosen and the multiple compressor system adapted accordingly.

The approach above may be described as below:

A method for controlling a multiple compressor system, wherein the multiple compressor system comprises a number of compressors together providing a common output flow, said method comprising receiving power/energy usage measurement data from a number of sensors connected to the number of compressors, respectively, over a period of time such that a power/energy usage measurement data set covering several compressor combinations and/or operating modes is provided, receiving, in parallel with receiving the power/energy usage measurement data, system operation data related to operational compressor combination(s) and operating mode(s) from the number of compressors such that system operation data set is provided, processing the power/energy usage measurement data set and the system operation data set by using a control unit such that data points, related to the power/energy usage measurement data set, are affiliated to operational compressor combination(s) and operating mode(s) by using the system operation data set, such that a measured specific energy consumption data set comprising power/energy usage measurement data for different compressor combinations and operating mode(s) is provided, selecting, based on the measured specific energy consumption data, a selected compressor combination, and configuring the multiple compressor system according to the selected compressor combination.

The power/energy usage measurement data may comprise measurement data of flow and power/energy consumption or estimated flow associated with the measured power/energy consumption.

Alternatively, if one system is used for collecting and processing data and another system is used for controlling the multiple compressor system, the approach may be described as below:

A method for monitoring a multiple compressor system, wherein the multiple compressor system comprises a number of compressors together providing a common output flow, said method comprising receiving power/energy usage measurement data from a number of sensors connected to the number of compressors, respectively, over a period of time such that a power/energy usage measurement data set covering several compressor combinations and/or operating modes is provided.

receiving, in parallel with receiving the power/energy usage measurement data, system operation data related to operational compressor combination(s) and operating mode(s) from the number of compressors such that system operation data set is provided, processing the power/energy usage measurement data set and the system operation data set by using a control unit such that data points, related to the power/energy usage measurement data set, are affiliated to operational compressor combination(s) and operating mode(s) by using the system operation data set, such that a measured specific energy consumption data set comprising power/energy usage measurement data for different compressor combinations and operating mode(s) is provided, such that, based on the measured specific energy consumption data, a selected compressor combination may be selected, and the multiple compressor system configured according to the selected compressor combination.

The power/energy usage measurement data may comprise measurement data of flow and power/energy consumption or estimated flow associated with the measured power/energy consumption.

The different features and advantages mentioned above with reference to the method set forth in claim 1 are also applicable to the methods above.

Figure 13:
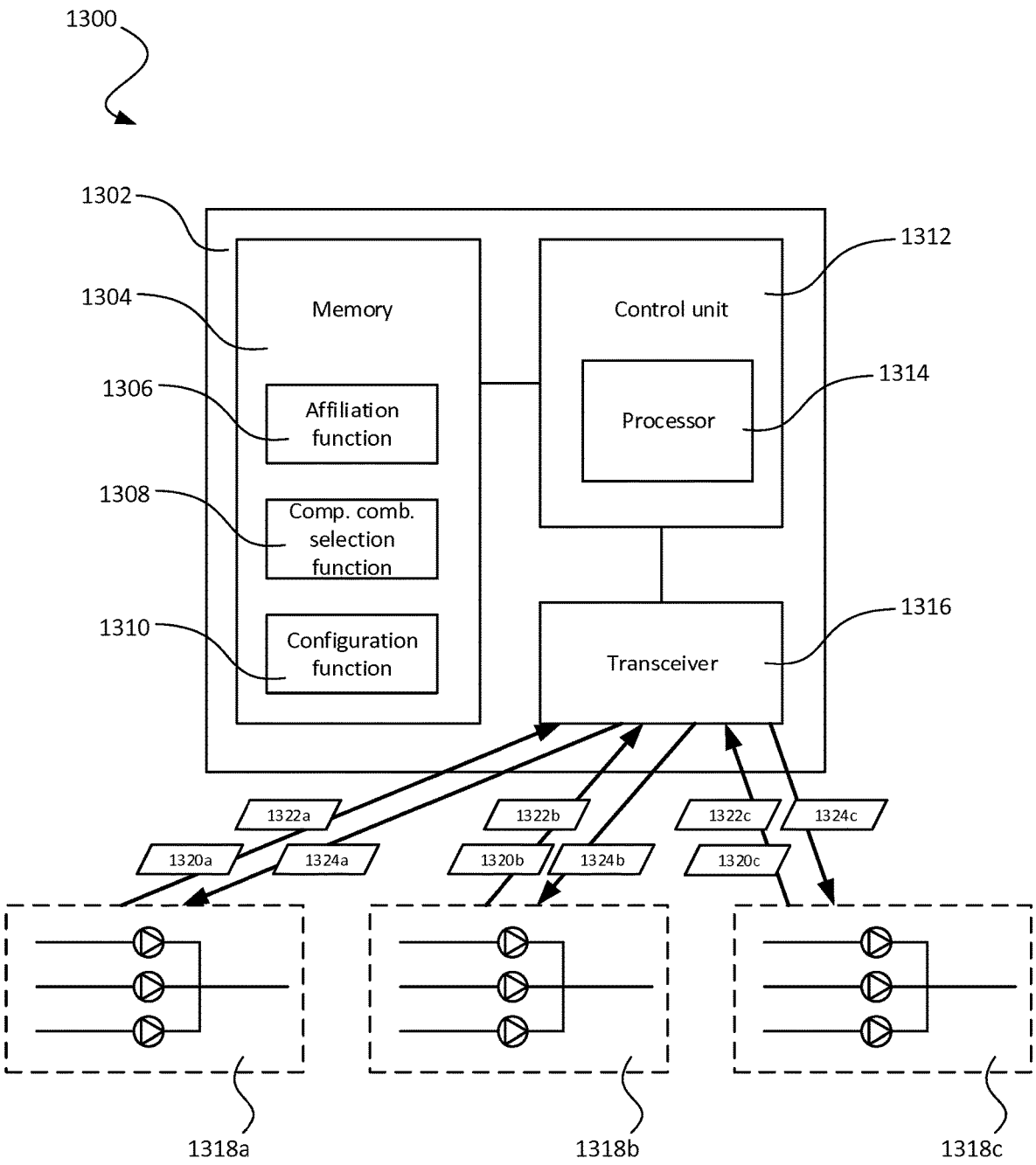

As illustrated in FIG. 13, a server 1302 may be used for implementing the approach described above. The server 1302 may be part of a system 1300, and can comprise a memory 1304 comprising an affiliation function 1306, a compressor combination selection function 1308 and a configuration function 1310. In short, the affiliation function 1306 can be configured to affiliate the power/energy usage measurement data set and the system operation data set as explained above. The compressor combination selection function 1308 can be configured such that based on the measured specific energy consumption data, a selected compressor combination can be selected. This selection may be based on user input or may be performed automatically by the server. The configuration function 1310 can be configured to configure the multiple compressor system according to the selected compressor combination, which may comprise changing the system operation data, that is, which compressor combination(s) and operating mode(s) that are in operation.

In addition, the server 1302 can comprise a control unit 1312, comprising a processor 1314, and a transceiver 1316. By using the transceiver 1316, data can be exchanged with multiple compressor systems 1318*a*, 1318*b*, 1318*c* communicatively connected to the server 1302. More particularly, power/energy use measurement data 1320*a*, 1320*b*, 1320*c* and system operation data 1322*a*, 1322*b*, 1322*c* may be transferred from the multiple compressor systems 1318*a*, 1318*b*, 1318*c* to the server 1302, and from the server 1302 configuration data 1324*a*, 1324*b*, 1324*c* may be transferred to the multiple compressor systems 1318*a*, 1318*b*, 1318*c*.

The approach described above, in the form of the server 1302, can be described as below:

The server 1302 configured to control the multiple compressor system 1318*a*, 1318*b*, 1318*c*, wherein the multiple compressor system comprises a number of compressors together providing a common output flow, said server comprising the transceiver 1316 configured to receive:

the power/energy use measurement data 1320*a*, 1320*b*, 1320*c* from a number of sensors connected to the number of compressors, respectively, over a period of time such that a power/energy usage measurement data set covering several compressor combinations and/or operating modes is provided;

the system operation data 1322*a*, 1322*b*, 1322*c* related to operational compressor combination and operating mode(s) from the number of compressors such that a system operation data set is provided, the control circuit 1312 configured to execute:

the affiliation function 1306 configured to process the power/energy usage measurement data set and the system operation data set such that data points, related to the power/energy usage measurement data set, are affiliated to operational compressor combination and operating mode(s) such that a measured specific energy consumption data set comprising power/energy usage measurement data for different compressor combinations and operating mode(s) is provided, the compressor combination selection function 1308 configured to select, based on the measured specific energy consumption data, the selected compressor combination, and the configuration function 1310 configured to configure the multiple compressor system 1318*a*, 1318*b*, 1318*c* according to the selected compressor combination using configuration data 1324*a*, 1324*b*, 1324*c*, wherein the transceiver is further configured to transfer:

the configuration data 1324*a*, 1324*b*, 1324*c* to the multiple compressor system 1318*a*, 138*b*, 1318*c*.

The power/energy usage measurement data may comprise measurement data of flow and power/energy consumption or estimated flow associated with the measured power/energy consumption.

Alternatively, as discussed above, if two or more systems are used the server may instead be described as below:

The server configured to monitor the multiple compressor system 1318*a*, 1318*b*, 1318*c*, wherein the multiple compressor system comprises a number of compressors together providing a common output flow, said server comprising the transceiver 1316 configured to receive:

the power/energy use measurement data 1320*a*, 1320*b*, 1320*c* from a number of sensors connected to the number of compressors, respectively, over a period of time such that a power/energy usage measurement data set covering several compressor combinations and/or operating modes is provided;

the system operation data 1322*a*, 1322*b*, 1322*c* related to operational compressor combination and operating mode(s) from the number of compressors such that a system operation data set is provided, a monitoring circuit configured to execute:

the affiliation function 1306 configured to process the power/energy usage measurement data set and the system operation data set such that data points, related to the power/energy usage measurement data set, are affiliated to operational compressor combination and operating mode(s) such that a measured specific energy consumption data set comprising power/energy usage measurement data for different compressor combinations and operating mode(s) is provided, wherein the transceiver is further configured to transfer the measured specific energy consumption data to other devices configured to execute the compressor combination selection function 1308 configured to select, based on the measured specific energy consumption data, the selected compressor combination, and the configuration function 1310 configured to configure the multiple compressor system 1318*a*, 1318*b*, 1318*c* according to the selected compressor combination using configuration data 1324*a*, 1324*b*, 1324*c*.

The power/energy usage measurement data may comprise measurement data of flow and power/energy consumption or estimated flow associated with the measured power/energy consumption.

The different features and advantages mentioned above with reference to the method set forth in claim 1 are also applicable to the servers above. Further, as illustrated, several multiple compressor systems may be connected to the server. In addition to reducing hardware costs, this also provides an advantage in that information from different multiple compressor systems may be compared and aligned. Thus, for instance, a positive side effect of using the server for assuring energy efficient operation for a plurality multiple compressor systems is that maintenance or service needs may be detected at an early stage by comparing the different multiple compressor systems to one another such that inconsistencies can be detected.

The invention claimed is:

1. A method for analyzing, monitoring, optimizing and/or comparing energy used for producing a unit of mass or volume of compressed gas (Specific Energy Consumption) in relation to a common output flow in a multiple compressor system, said method comprising:

collecting measured data of common output flow and energy/power use and calculating the specific energy consumption in the multiple compressor system, identifying which data points of the specific energy consumption that affiliate to a certain compressor or compressor combination in the multiple compressor system and/or operating mode(s) of the multiple compressor system;

plotting the data points of the specific energy consumption that affiliate to a certain compressor or compressor combination in the multiple compressor system and/or operating mode of the multiple compressor system and marking affiliation of said data points to the certain compressor or compressor combination and/or operating mode, wherein an ideal specific energy consumption curve(s) is plotted and each ideal specific energy consumption curve is complemented with another curve visualizing the working limit for each certain compressor or compressor combination in the multiple compressor system, and wherein the curves together form a working area for each certain compressor or compressor combination in the multiple compressor system and adapting the multiple compressor system based on the data points of the specific energy consumption.

2. The method according to claim 1, wherein plotting the data points is performed in a chart of specific energy consumption vs common output flow.

3. The method according to claim 1, wherein said method also comprises from a the first compressor, constructing an ideal specific energy consumption curve in the first compressor as a function of the output flow of the first compressor; and from a first compressor and a second compressor, calculating a combined ideal specific energy consumption curve in the first compressor and the second compressor as a function of the combined output flow of the first compressor and the second compressor, and wherein the method comprises structuring calculated data to be visualized in ideal specific energy consumption curves, to analyze, monitor, optimize and/or compare with measured data for a corresponding multiple compressor system.

4. The method according to claim 1, wherein constructed curves and/or measurement data points in the plots are linked to different compressor combinations, operation modes and/or transitions between different operation modes or compressor combinations and where the links are visualized by markings such as front- or background colors, symbols, separation into different sub-plots or similar to enable analysis of the effects of transitions and operating combinations in the multiple compressor system.

5. The method according to claim 3, wherein the method involves constructing and visualizing the ideal specific energy consumption curve(s) for one or more fixed system reference pressure(s) and/or inlet conditions.

6. The method according to claim 3, wherein the method involves constructing and visualizing one or several ideal specific energy consumption curve(s) for compressor combination(s), in any combination(s).

7. The method according to claim 3, wherein the method involves constructing and visualizing one or several ideal specific energy consumption curves(s) for compressor combination(s), in any combination(s), and wherein at least one combination is based on combining adjustable flow ranges of individual compressors.

8. The method according to claim 3, wherein the calculation of ideal specific energy consumption curves is based on combining non-adjustable flow ranges and adjustable flow ranges for individual compressors separately to form one single virtual compressor.

9. The method according to claim 3, wherein the ideal specific energy consumption curve(s) is calculated with specific energy consumption set as a constant or close to constant within a compressor(s) regulating flow range and where ideal specific energy consumption is calculated from a constant power use for a compressor(s) non-regulating flow range.

10. The method according to claim 3, wherein the ideal specific energy consumption curve(s) is adjusted for efficiency variations within a regulating flow range compared to a constant specific energy consumption and/or wherein the ideal specific energy consumption curve(s) is calculated employing design or performance curves of tho individual compressors.

11. The method according to claim 1, wherein data points outside of the working area(s) for each certain compressor or compressor combination in the multiple compressor system are identified and/or indicated as measuring errors or system or equipment faults.

12. The method according to claim 1, wherein the working limit curve is constructed and plotted as an ideal specific energy consumption curve independent of regulating capabilities of any of the compressors involved in the compressor combination.

* * * * *